US007420513B2

(12) United States Patent
Tsutsumi et al.

(10) Patent No.: US 7,420,513 B2
(45) Date of Patent: Sep. 2, 2008

(54) CIRCULARLY POLARIZED ANTENNA DEVICE

(75) Inventors: Yukako Tsutsumi, Yokohama (JP); Masaki Nishio, Tokyo (JP); Shuichi Sekine, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/739,408

(22) Filed: Apr. 24, 2007

(65) Prior Publication Data

US 2007/0285334 A1 Dec. 13, 2007

(30) Foreign Application Priority Data

Jun. 12, 2006 (JP) ..... 2006-162619

(51) Int. Cl.
*H01Q 1/38* (2006.01)

(52) U.S. Cl. ..... 343/700 MS; 343/833; 343/846

(58) Field of Classification Search ..... 343/700 MS, 343/833, 834, 846, 848
See application file for complete search history.

(56) References Cited

U.S. PATENT DOCUMENTS 6,369,762 B1 4/2002 Yanagisawa et al.
6,816,127 B2 11/2004 McKivergan et al.
7,026,996 B2 * 4/2006 Harano ..... 343/700 MS
7,330,153 B2 * 2/2008 Rentz ..... 343/700 MS
7,333,068 B2 * 2/2008 Biddulph ..... 343/794
2001/0023178 A1 9/2001 Amano et al.
2005/0143151 A1 6/2005 Ito et al.
2007/0057849 A1 * 3/2007 Moon et al. ..... 343/700 MS

FOREIGN PATENT DOCUMENTS

JP 2005-101761 4/2005
JP 2005-236656 9/2005

* cited by examiner

*Primary Examiner*—Tan Ho
(74) *Attorney, Agent, or Firm*—Oblon, Spivak, McClelland, Maier & Neustadt, P.C.

(57) ABSTRACT

First and second monopole conductive elements are disposed so as to be approximately mutually perpendicular and so that respective open ends are adjacent, and with respect to a straight line that passes between open ends of the first and second monopole conductive elements and through a center of a conductive ground plane, a first conductive ground plane portion formed on a first monopole conductive element-side of the straight line among the conductive ground plane and the first monopole conductive element are formed so as to be approximately symmetrical to a second conductive ground plane portion formed on a second monopole conductive element-side of the straight line among the conductive ground plane and the second monopole conductive element.

15 Claims, 11 Drawing Sheets

10

CIRCULARLY POLARIZED ANTENNA DEVICE

CROSS REFERENCE TO RELATED APPLICATIONS

This application is based upon and claims the benefit of priority from the prior Japanese Patent Applications No. 2006-162619, filed on Jun. 12, 2006; the entire contents of which are incorporated herein by reference.

BACKGROUND OF THE INVENTION

1. Field of the Invention

The present invention relates to a circularly polarized antenna device that transmits and receives circularly polarized waves.

2. Related Art

There is known a circularly polarized antenna device configured so as to combine a monopole antenna having a feeding point and an open end with a linear parasitic conductive element perpendicular to the monopole antenna, and provided therebetween with a power delivery section so that circularly polarized waves (polarized waves with polarization planes that rotate over time) are receivable (for instance, refer to Patent Document 1).

[Patent Document 1] Japanese Patent Laid-Open No. 2005-236656 (FIG. 2)

In the above-described conventional circularly polarized antenna device, there is a problem in that the parasitic element requires a length of ½ wavelength and is distanced from the ground plane, resulting in a large overall configuration area.

SUMMARY OF THE INVENTION

An object of the present invention is to provide a circularly polarized antenna device having a good axial ratio (the ratio of the major axis and the minor axis in an elliptically polarized wave) in a maximum radiation direction and wideband frequency characteristics using a simple configuration.

A circularly polarized antenna device according to an aspect of the present invention is provided with:

a conductive ground plane;

first and second monopole conductive elements having approximately the same length and respectively connected via connection points to the conductive ground plane; and a feeding point provided at either one of the connection points; wherein the first and second monopole conductive elements are approximately mutually perpendicular and are disposed so that respective open ends thereof are mutually adjacent, and with respect to a straight line passing between the open ends of the first and second monopole conductive elements and through the center of the conductive ground plane, a first conductive ground plane portion formed on a first monopole conductive element-side of the straight line among the conductive ground plane and the first monopole conductive element are formed so as to be approximately symmetrical to a second conductive ground plane portion formed on a second monopole conductive element-side of the straight line among the conductive ground plane and the second monopole conductive element.

In addition, a circularly polarized antenna device according to an aspect of the present invention is provided with:

a conductive ground plane;

a conductive element connected to the conductive ground plane and formed so as to have an approximately symmetrical shape with respect to a straight line passing through the center of the conductive ground plane and a connection point connected to the conductive ground plane;

first and second monopole conductive elements connected to the conductive ground plane and having approximately half the length of the conductive element;

a feeding point provided at the connection point of the conductive element and the conductive ground plane; and first and second switches respectively provided on the first and second monopole conductive elements, which switch between connection and nonconnection of the conductive ground plane with the first and second monopole conductive elements; wherein among the conductive element, a first conductive element portion formed on a first monopole conductive element-side of the feeding point and the first monopole conductive element are mutually perpendicular and are arranged so that a first open end of the conductive element and an open end of the first monopole conductive element are mutually adjacent, among the conductive element a second conductive element portion formed on a second monopole conductive element-side of the feeding point and the second monopole conductive element are mutually perpendicular and are arranged so that a second open end of the conductive element and an open end of the second monopole conductive element are mutually adjacent, with respect to a first straight line passing between the first open end of the conductive element and the open end of the first monopole conductive element and through the center of the conductive ground plane, a first conductive ground plane portion formed on a first conductive element-side of the first straight line among the conductive ground plane and the first conductive element portion are formed so as to be approximately symmetrical to a second conductive ground plane portion formed on a first monopole conductive element-side of the first straight line among the conductive ground plane and the first monopole conductive element, and with respect to a second straight line passing between the second open end of the conductive element and the open end of the second monopole conductive elements and through the center of the conductive ground plane, a third conductive ground plane portion formed on a second conductive element-side of the second straight line among the conductive ground plane and the second conductive element portion are formed so as to be approximately symmetrical to a fourth conductive ground plane portion formed on a second monopole conductive element-side of the second straight line among the conductive ground plane and the second monopole conductive element.

DETAILED DESCRIPTION OF THE INVENTION

Embodiments of the present invention will now be described in detail with reference to the drawings.

(1) First Embodiment

Figure 1:
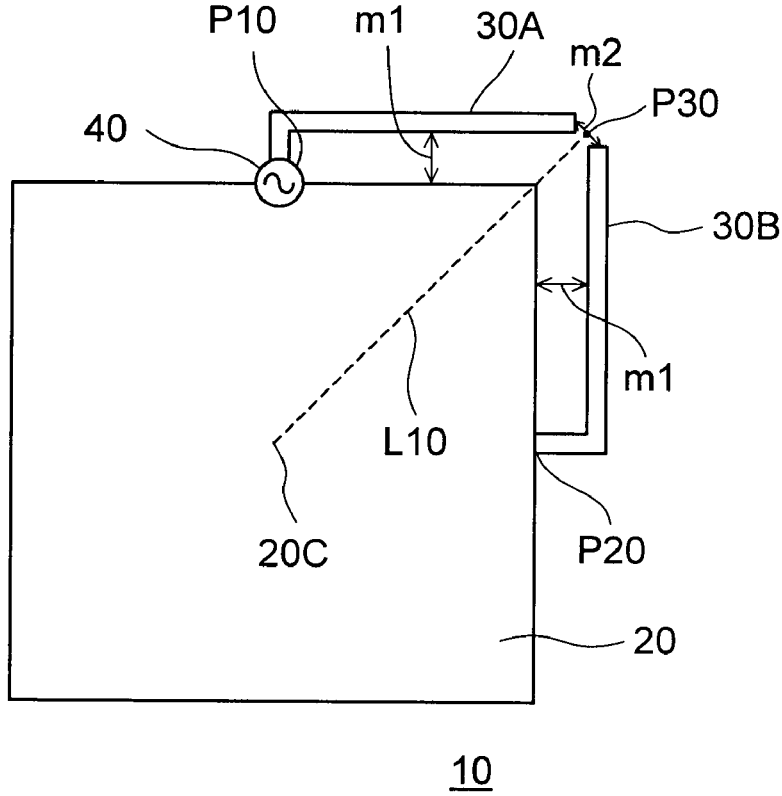
FIG. 1 is a diagram showing a general configuration of a circularly polarized antenna device according to a first embodiment of the present invention.

FIG. 1 is a diagram showing a general configuration of a circularly polarized antenna device 10 according to a first embodiment of the present invention. The circularly polarized antenna device 10 shown in FIG. 1 is provided with: a quadrate-shaped conductive ground plane 20; L-shaped monopole conductive elements 30A and 30B having lengths of approximately ¼ wavelength and respectively connected to a point P10 that is bilaterally symmetrical with respect to sides of a periphery of the conductive ground plane 20 and a position P20 having a 90-degree angular difference from the point P10 with respect to a center 20C of the conductive ground plane 20; and a feeding point 40 provided at the connecting point P10 of one of the L-shaped monopole conductive elements 30A. The two L-shaped monopole conductive elements 30A and 30B are approximately symmetrical with respect to a line segment L10 connecting a midpoint P30 between open ends of the L-shaped monopole conductive elements 30A and 30B and the center 20C of the conductive ground plane 20, and are disposed so that respective open ends thereof are mutually perpendicular and adjacent. The position P20 need not have an angular difference of precisely 90 degrees from the point P10 with respect to the center 20C of the conductive ground plane 20, and should merely have an angular difference of approximately 90 degrees.

Figure 2A:
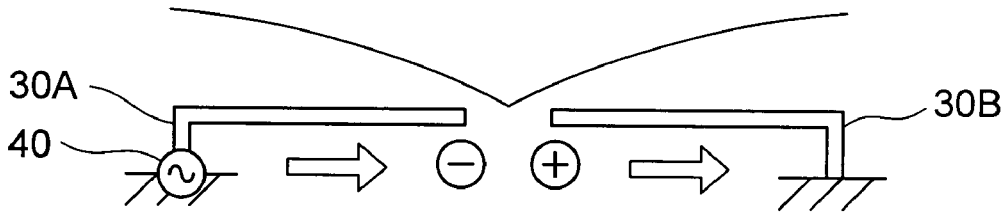
FIG. 2A-2B are pattern diagrams of electrical current distribution.
Figure 2B:
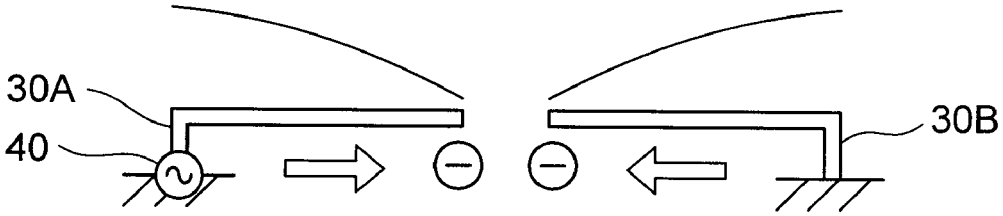

Next, a principle of operation of the circularly polarized wave antenna device 10 will be described. FIG. 2 shows pattern diagrams of electrical current distribution (magnitude of electrical current), in which FIG. 2(A) shows a first operational state, while FIG. 2(B) shows a second operational state. In the diagrams, "+" indicates a high level of positive charges, "−" indicates a high level of electrons, and arrows indicate directions of electrical current. In reality, the open ends of the two L-shaped monopole conductive elements 30A and 30B are disposed so as to be mutually approximately perpendicular and adjacent.

In the first operational state shown in FIG. 2(A), since the value of floating capacitance occurring between the open ends of the two L-shaped monopole conductive elements 30A and 30B is significant, the electrical lengths of the L-shaped monopole conductive elements 30A and 30B increase, and resonance occurs at a low frequency position. At this point, a high level of opposite-sign charges exist at the respective open ends of the L-shaped monopole conductive elements 30A and 30B, and currents of the same phase flow through the respective L-shaped monopole conductive elements 30A and 30B (phase difference of 0 degrees).

On the other hand, in the second operational state shown in FIG. 2(B), since the value of floating capacitance occurring between the open ends of the two L-shaped monopole conductive elements 30A and 30B is low, the electrical lengths of the L-shaped monopole conductive elements 30A and 30B are equal to the lengths of the elements, and resonance occurs at a high frequency position. At this point, a high level of same-sign charges exist at the respective open ends of the L-shaped monopole conductive elements 30A and 30B, and currents of reverse phases flow through the respective L-shaped monopole conductive elements 30A and 30B (phase difference of 180 degrees).

A point (not shown) at which the respective L-shaped monopole conductive elements 30A and 30B have a phase difference of 90 degrees exists between a frequency of the first operational state and a frequency of the second operational state. In addition, since the conductive ground plane 20 having a 4-fold rotationally symmetrical shape (a shape of a figure that matches its original shape when the figure is rotated by 90 degrees) and two L-shaped monopole conductive elements 30A and 30B are symmetrically disposed, the orthogonality of electrical current distribution may be preserved.

Incidentally, a circularly polarized wave occurs when the sizes of two mutually perpendicular currents are the same and a phase difference of 90 degrees exist therebetween. This circularly polarized antenna device 10 radiates circularly polarized waves (which approximate perfect circles) having a good axial ratio in a maximum radiation direction or, in other words, a direction perpendicular to the two L-shaped monopole conductive elements 30A and 30B by adjusting and determining a distance "m1" from the sides of the conductive ground plane 20 to the L-shaped monopole conductive elements 30A and 30B parallel thereto and a distance "m2" between the open ends of the two L-shaped monopole conductive elements 30A and 30B so that the phase difference between the currents respectively flowing through the two L-shaped monopole conductive elements 30A and 30B is 90 degrees.

Figure 3:
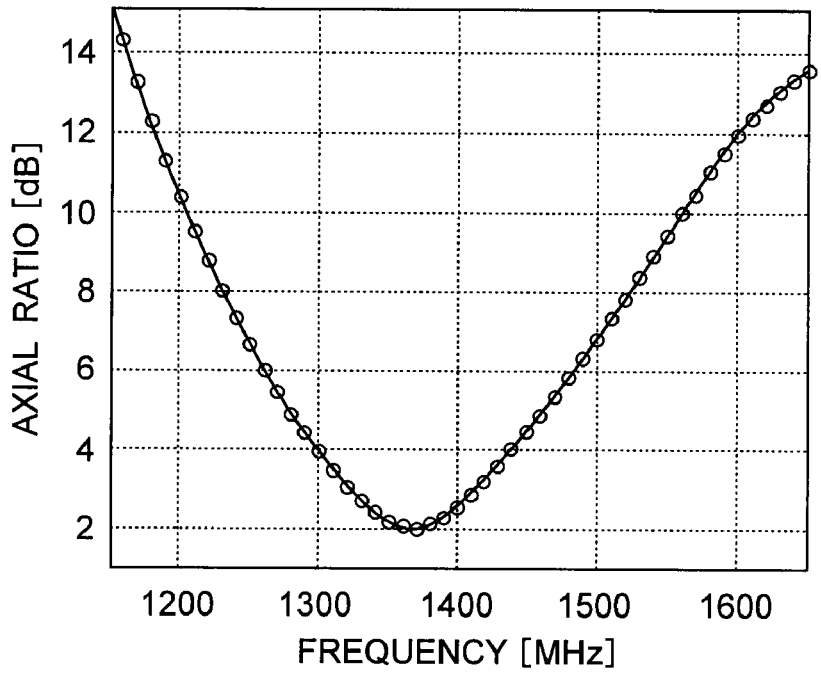
FIG. 3 is a diagram showing axial ratio-frequency characteristics of the circularly polarized antenna device.

FIG. 3 is a graph showing axial ratio-frequency characteristics in a maximum radiation direction when, in FIG. 1, the conductive ground plane 20 is arranged as a quadrate 80 mm on a side, the entire lengths of the L-shaped monopole conductive elements 30A and 30B are set to 52 mm, the distance between the sides of the conductive ground plane 20 to the L-shaped monopole conductive elements 30A and 30B parallel thereto is set to 8 mm, and the distance between the open ends of the two L-shaped monopole conductive elements 30A and 30B is set to 5.7 mm. This graph is created based on a result of a simulation performed by the present inventors.

Figure 4:
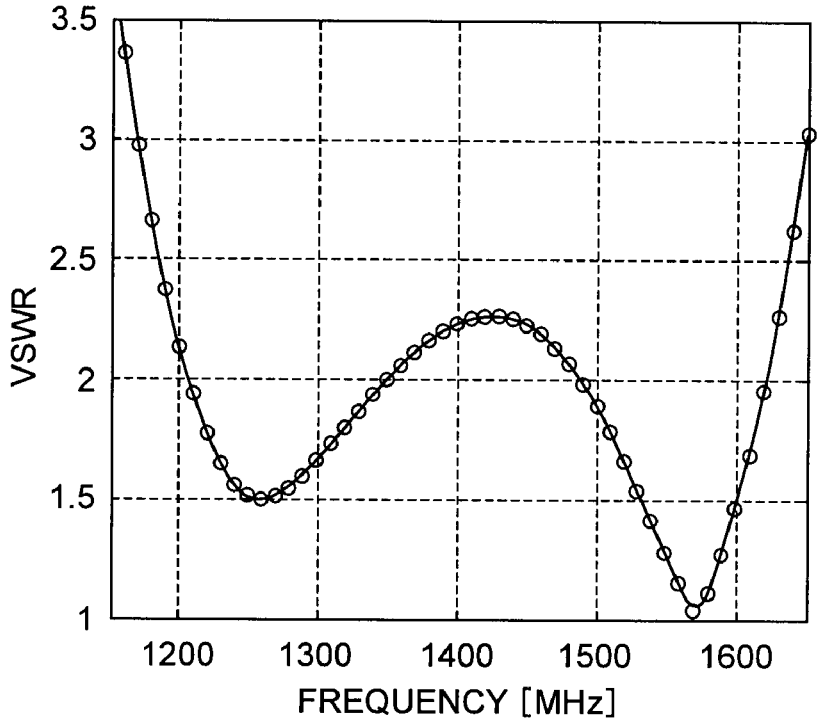
FIG. 4 is a diagram showing impedance-frequency characteristics of the circularly polarized antenna device.
Figure 5:
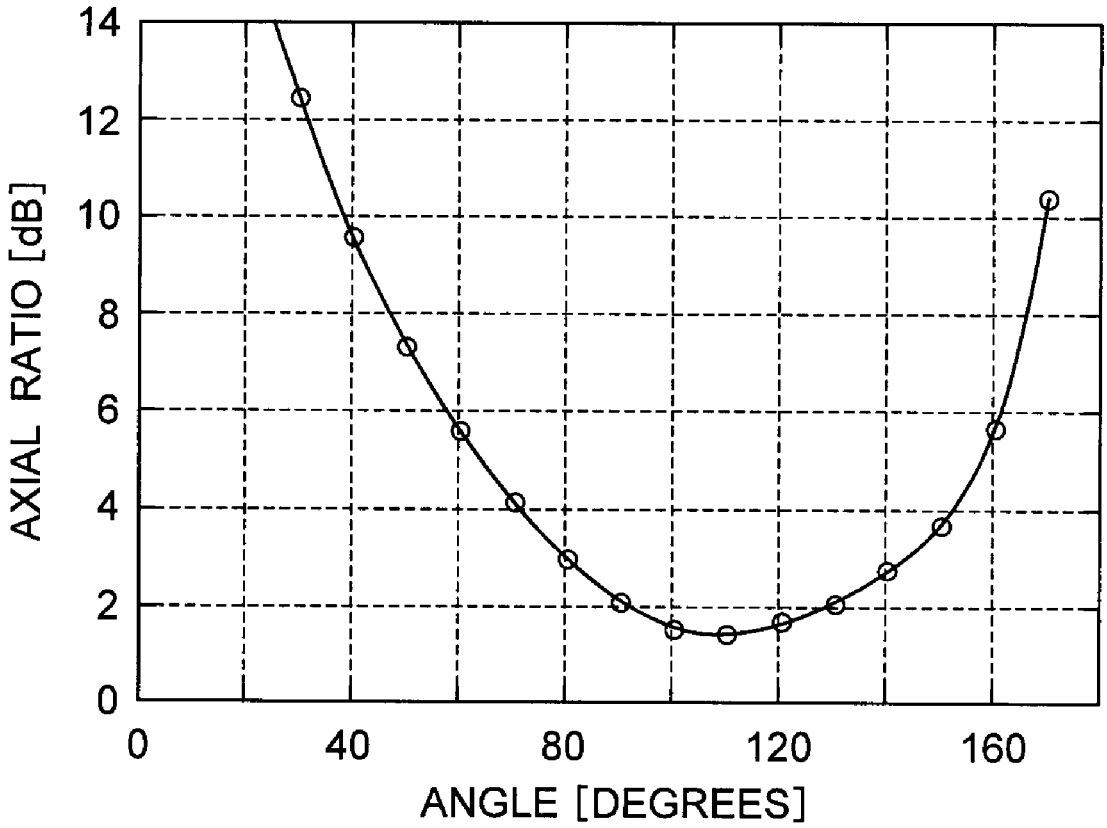
FIG. 5 is a diagram showing radiation characteristics of the circularly polarized antenna device.

FIG. 4 is a graph showing frequency characteristics of impedance or, in other words, VSWR (voltage standing wave ratio), created based on the same simulation result. FIG. 5 is a graph showing radiation characteristics at a central frequency of 1370 MHz, created based on the same simulation result.

As may be seen from FIG. 3, a relative frequency band, in which the axial ratio is equal to or less than 3 dB in a maximum radiation direction, is approximately 6.5% (a well-known one-point feeding microstrip antenna has a relative band of approximately 1%). The lower dB-displayed value means that the axial ratio is better. The relative band is calculated by dividing a bandwidth by the central frequency 1370 MHz.

As may be seen from FIG. 4, a relative frequency band, in which the VSWR is equal to or less than 2.5, is equal to or more than 30% (a well-known one-point feeding microstrip antenna has a relative band of approximately 2%). The relative band is calculated by dividing a bandwidth by the central frequency 1370 MHz. In addition, as may be seen from FIG. 5, the configuration has wide-angled characteristics. The axial ratios are equal to or less than 3 dB in a range equal to or more than 60 degrees.

Since the L-shaped monopole conductive elements 30A and 30B are disposed along the periphery of the conductive ground plane 20, the entire structure including the conductive ground plane 20 may be configured smaller than a quadrate, approximate half-wavelength on a side.

The axial ratio characteristics and the impedance characteristics change by the distance "m1" from the sides of the conductive ground plane 20 to the L-shaped monopole conductive elements 30A and 30B parallel thereto and the distance "m2" between the open ends of the two L-shaped monopole conductive elements 30A and 30B. The best axial ratio characteristics and impedance characteristics may be achieved when the distance from the sides of the conductive ground plane 20 to the L-shaped monopole conductive elements 30A and 30B parallel thereto is approximately 1/25 wavelength, and the distance between the open ends of the two L-shaped monopole conductive elements 30A and 30B is approximately 1/40 wavelength.

As seen, according to the present embodiment, by configuring the two L-shaped monopole conductive elements 30A and 30B so as to be approximately perpendicular, the open ends of the L-shaped monopole conductive elements 30A and 30B to be adjacent, and the entire structure including the conductive ground plane to have an approximately symmetrical property, circularly polarized waves having a good axial ratio in a maximum radiation direction and the wideband frequency characteristics (that a relative band in which the axial ratio is equal to or less than 3 dB, is around 6%, and a relative band in which the VSWR is equal to or less than 3, is around 30%) may be generated. The configuration is simple, and without needing complicated two-point feeding that requires a phase shifter to produce a 90-degree phase difference.

In addition, since the L-shaped monopole conductive elements 30A and 30B are disposed along the periphery of the conductive ground plane 20, the entire structure including the conductive ground plane 20 may be configured smaller than a quadrate, approximate half-wavelength on a side.

Furthermore, by disposing the conductive ground plane 20 and the L-shaped monopole conductive elements 30A and 30B at same heights, a planar configuration may be realized easily on a dielectric plate.

Incidentally, the circularly polarized antenna device 10 according to the present invention may be used in, for instance, a wideband millimeter wave radio communication device used in a large-capacity video transmission system. Since a wide frequency bandwidth can be used, the millimeter wave frequency band is suitable for the high-speed communication such as uncompressed video transmission. The circularly polarized antenna device according to the present embodiment is suitable for this application.

The above-described first embodiment is merely an example, and is not intended to limit the present invention. Another example of the first embodiment will now be described.

Figure 6A:
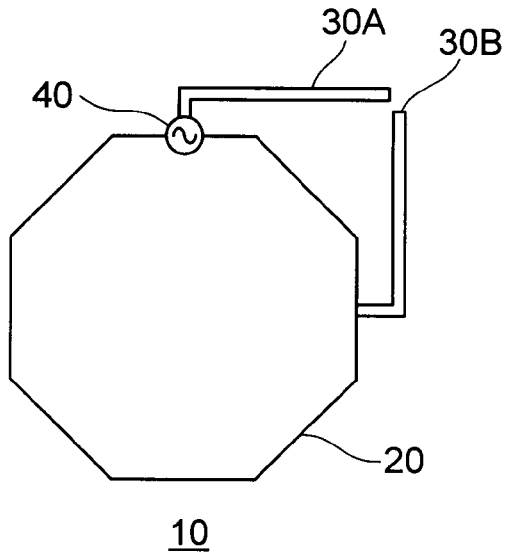
FIG. 6A-6C are diagrams showing another example of the first embodiment in which the shape of a conductive ground plane has been changed.
Figure 6B:
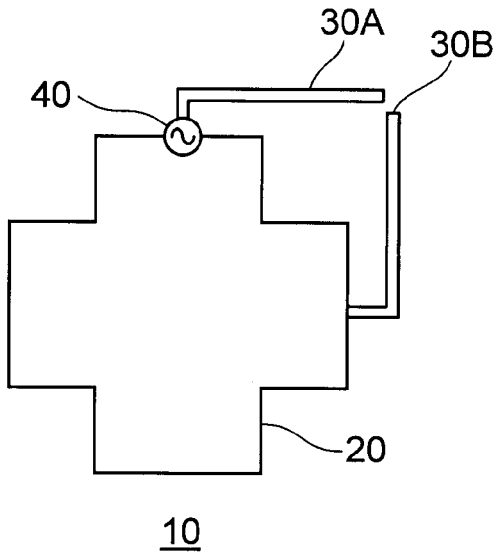
Figure 6C:
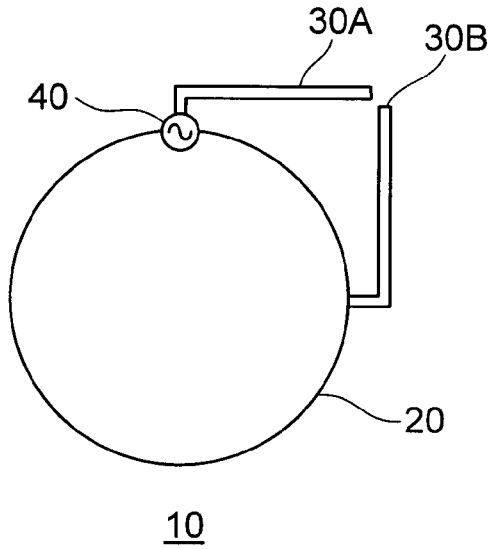
Figure 7A:
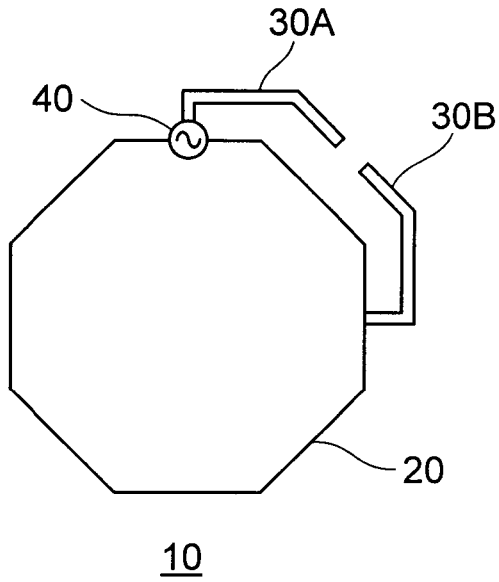
FIG. 7A-7C are diagrams showing another example of the first embodiment in which the shape of a L-shaped monopole conductive element has been changed.
Figure 7B:
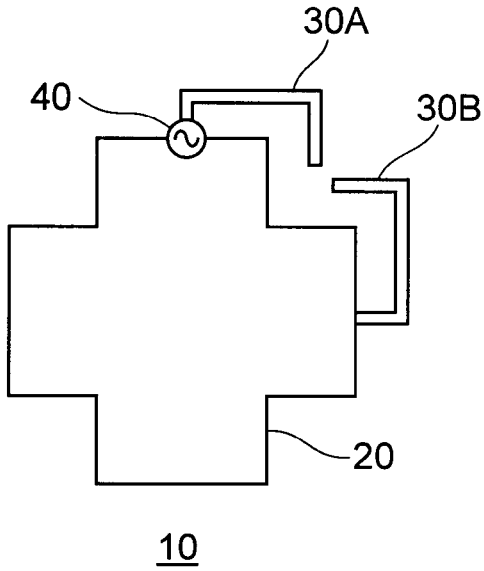
Figure 7C:
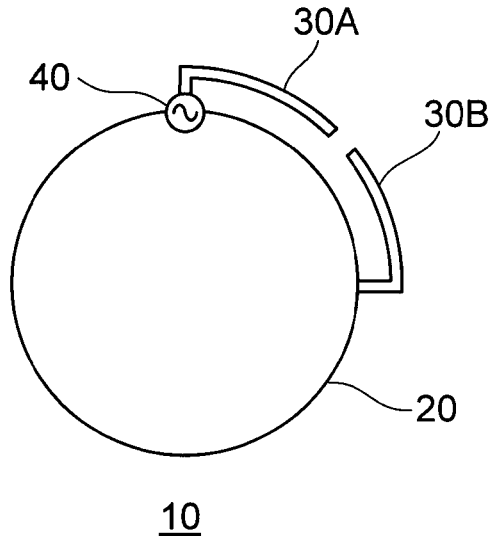
Figure 8:
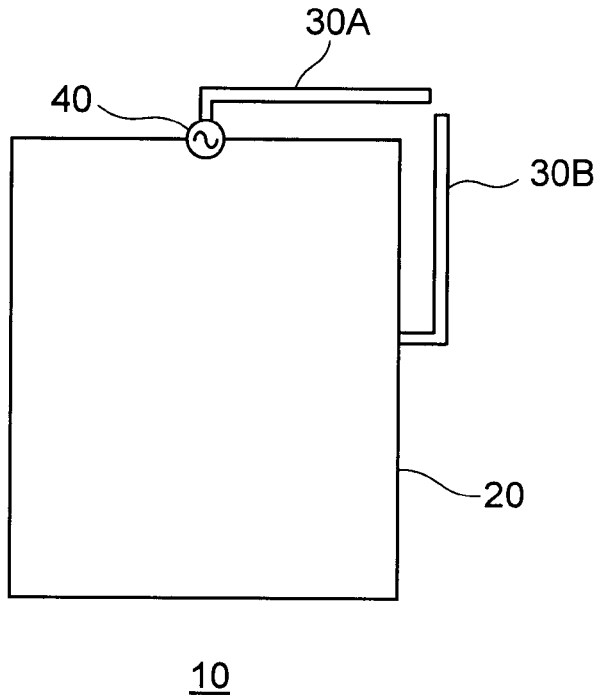
FIG. 8 is a diagram showing another example of the first embodiment in which the shape of the conductive ground plane has been changed.

FIG. 6 is a variation of FIG. 1, in which the shape of the conductive ground plane 20 is changed from a quadrate to a 4-fold rotationally symmetrical shape. A 4-fold rotationally symmetrical shape refers to a shape of a figure that matches its original shape when the figure is rotated by 90 degrees. Here, an octagon shown in FIG. 6(A), a cross shape shown in (B), and a circular shape shown in (C) have been given as examples. FIG. 7 is a further variation of FIG. 6, and shows an arrangement in which the two L-shaped monopole conductive elements 30A and 30B are shaped in conformity to the sides of the peripheries of the conductive ground planes 20. FIG. 8 is a variation of FIG. 1, in which the shape of the conductive ground plane 20 is changed to a rectangle. As shown in FIGS. 6 to 8, by deforming the conductive ground plane 20 and the L-shaped monopole conductive elements 30A and 30B according to a location at which the circularly polarized antenna device 10 is to be implemented, space saving may be achieved.

(2) Second Embodiment

Figure 9:
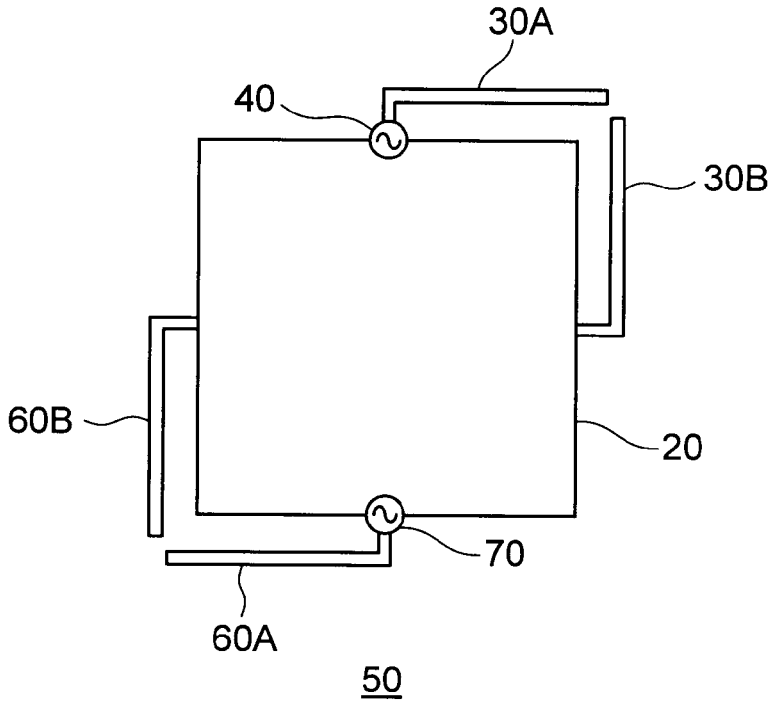
FIG. 9 is a diagram showing a general configuration of a circularly polarized antenna device according to a second embodiment of the present invention.

FIG. 9 is a diagram showing a general configuration of a circularly polarized antenna device 50 according to a second embodiment of the present invention. The second embodiment is arranged so that another set of two L-shaped monopole conductive elements 60A and 60B, and a feeding point 70, is newly provided at a position that is diagonal to the set shown in FIG. 1.

By newly providing another set of the two L-shaped monopole conductive elements 60A and 60B, and the feeding point 70 at a diagonal position, the symmetrical property of the shape may be preserved, and in the same manner as the circularly polarized antenna device 10 shown in FIG. 1, circularly polarized waves having a good axial ratio in a maximum radiation direction, the wideband frequency and wide angle characteristics may be generated.

In addition, when normally using same antennas for both transmission and reception, two sets including conductive ground planes will be required and thus a large area will be occupied. However, with the circularly polarized antenna device 50 shown in FIG. 9, the conductive ground plane 20 acts as a conductive ground plane for the two sets of L-shaped monopole conductive elements 30A, 30B and 60A, 60B as well as the feeding points 40 and 70, thereby enabling the two antennas to be configured with hardly any increase in area as compared to the circularly polarized antenna device 10 shown in FIG. 1.

As seen, according to the present embodiment, by disposing another set of L-shaped monopole conductive elements 60A, 60B and the feeding point 70 so as to achieve good symmetry with respect to a single conductive ground plane 20, a circularly polarized antenna (for instance, a transmitting and receiving antenna) having good axial ratios in two maximum radiation directions, the wideband frequency and wide angle characteristics may be configured with hardly any increase in area.

The above-described second embodiment is merely an example, and is not intended to limit the present invention. Another example of the second embodiment will now be described.

Figure 10:
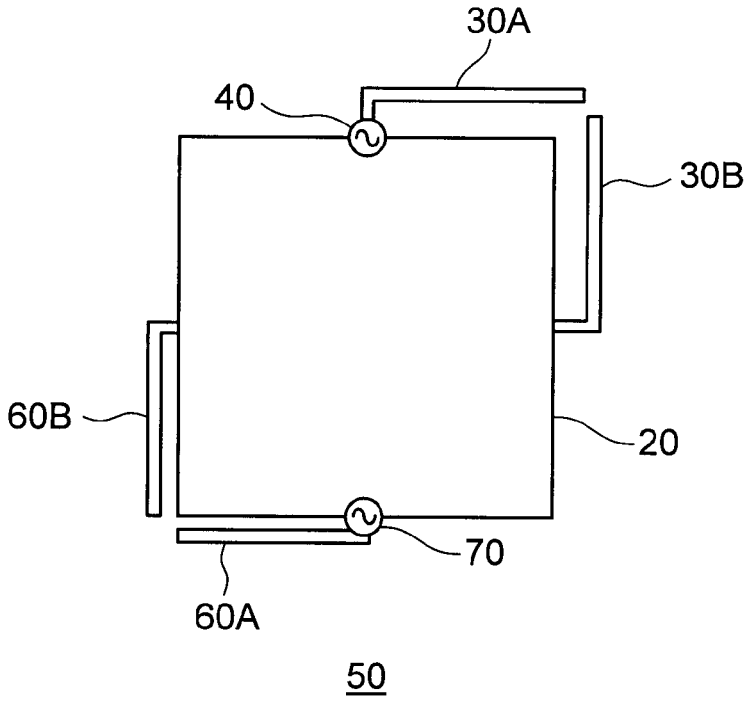
FIG. 10 is a diagram showing another example of the second embodiment in which the length of one of the pairs of two L-shaped monopole conductive elements has been changed.

FIG. 10 is a variation of FIG. 9, in which, among the two sets of L-shaped monopole conductive elements 30A, 30B and 60A, 60B, the length of one set of L-shaped monopole conductive elements 60A and 60B is different. By changing the length of one of the set of L-shaped monopole conductive elements 60A and 60B, two circularly polarized antennas that operate at different central frequencies may be configured in a small size.

(3) Third Embodiment

Figure 11:
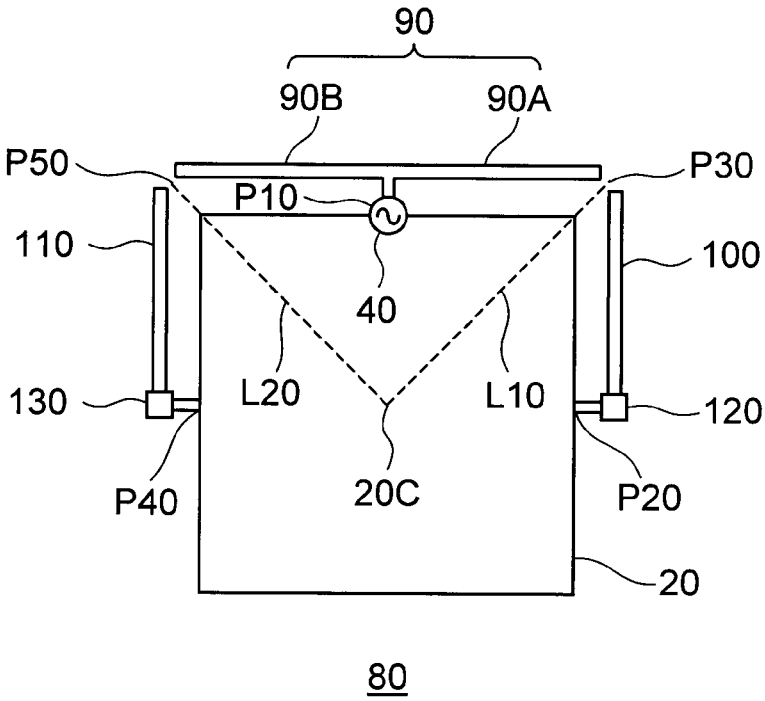
FIG. 11 is a diagram showing a general configuration of a circularly polarized antenna device according to a third embodiment of the present invention.

FIG. 11 is a diagram showing a general configuration of a circularly polarized antenna device 80 according to a third embodiment of the present invention. The circularly polarized antenna device 80 shown in FIG. 11 is provided with: a quadrate-shaped conductive ground plane 20; a T-shaped conductive element 90 having a length between an open end and other open end thereof of approximately ½ wavelength, and disposed at a point P10 that is bilaterally symmetrical with respect to sides of a periphery of the conductive ground plane 20; a feeding point 40 provided at the connecting point P10 of the conductive ground plane 10 and the T-shaped monopole conductive element 90; two L-shaped monopole conductive elements 100 and 110 having lengths of approximately ¼ wavelength and respectively connected to positions P20 and P40 that have angular differences of plus-minus 90 degrees from the connection point P10 of the T-shaped conductive element 90 with respect to a center 20C of the conductive ground plane 20; and switches 120 and 130 that switch between connection and nonconnection of the conductive ground plane 20 to the respective L-shaped monopole conductive elements 100 and 110.

The circularly polarized antenna device 80 is further arranged so that: a right-side portion 90A of the T-shaped conductive element 90 and the L-shaped monopole conductive element 100 are symmetrical with respect to a line segment 110 connecting a center P30 of the positive 90-degree difference and the center 20C of the conductive ground plane 20; a left-side portion 90B of the T-shaped conductive element 90 and the L-shaped monopole conductive element 110 are symmetrical with respect to a line segment 120 connecting a center P50 of the negative 90-degree difference and the center 20C of the conductive ground plane 20; and the two open ends of the T-shaped conductive element 90 and the open ends of the two L-shaped monopole conductive elements 100 and 110 are respectively mutually perpendicular and adjacent.

By turning off one of the switches 120 or 130 and turning on the other switch 130 or 120, one of the L-shaped monopole conductive elements 100 or 110 will be disconnected from the conductive ground plane 20 while the other L-shaped monopole conductive element 110 or 100 will be connected to the conductive ground plane 20.

On the L-shaped monopole conductive element 100 or 110 not connected to the conductive ground plane 20, since both ends are opened at a length of approximately ¼ wavelength, hardly any current is distributed and it does not contribute to the radiation there. Since the other L-shaped monopole conductive element 110 or 100 is connected to the conductive ground plane 20, current will be distributed.

Floating capacitance occurs at the open end of the L-shaped monopole conductive element 110 or 100 connected to the conductive ground plane 20 and the open end of the T-shaped conductive element 90. Therefore, circularly polarized waves having a good axial ratio in a maximum radiation direction may be obtained according to a principle similar to that of the circularly polarized antenna device 10 shown in FIG. 1. By reversing the on/off states of the switches 120 and 130, an element (the L-shaped monopole conductive element 100 or 110) having a leading phase with respect to the feeding element (the T-shaped conductive element 90) will be switched from left to right and vice versa. Therefore, switching between left-handed and right-handed circularly polarized waves may be performed according to circumstances or purposes.

As seen, according to the present embodiment, by using the T-shaped conductive element 90 as a feeding element, and by providing the L-shaped monopole conductive elements 100 and 110 respectively attached with the switches 120 and 130 to the left and right of the T-shaped conductive element 90, a circularly polarized antenna 80 having a good axial ratio in a maximum radiation direction and capable of switching between left-handed and right-handed circularly polarized waves by turning on/off the switches 120 and 130 may be configured with hardly any increase in area.

The above-described third embodiment is merely an example, and is not intended to limit the present invention. Another example of the third embodiment will now be described.

Figure 12A:
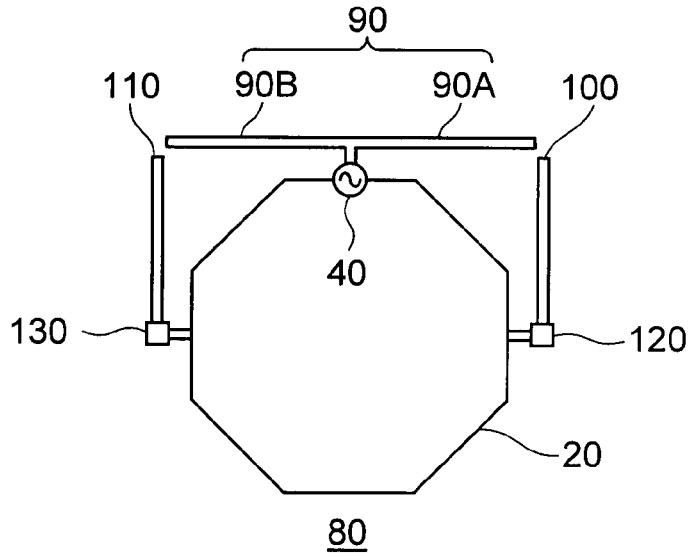
FIG. 12A-12C are diagrams showing another example of the third embodiment in which the shape of a conductive ground plane has been changed.
Figure 12B:
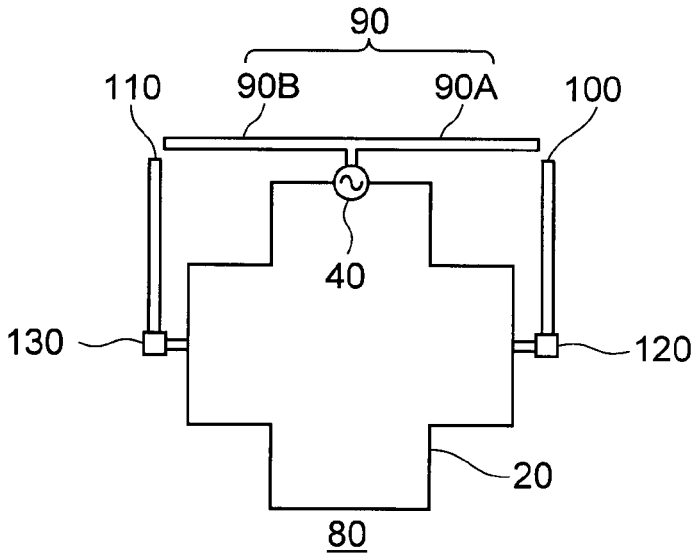
Figure 12C:
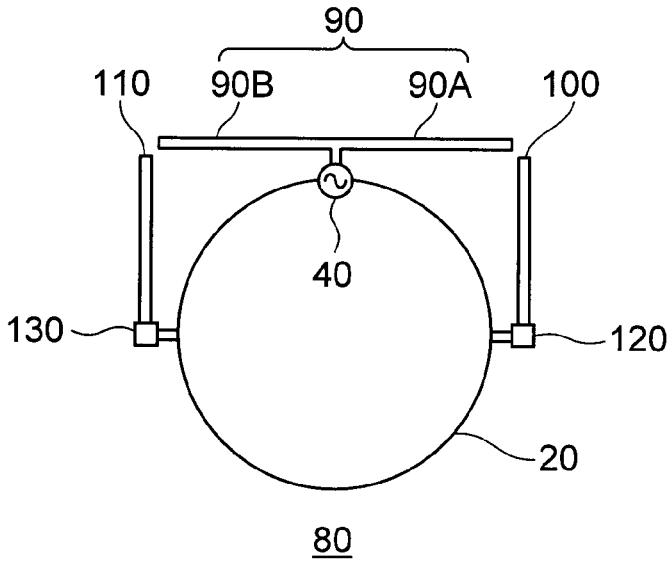
Figure 13A:
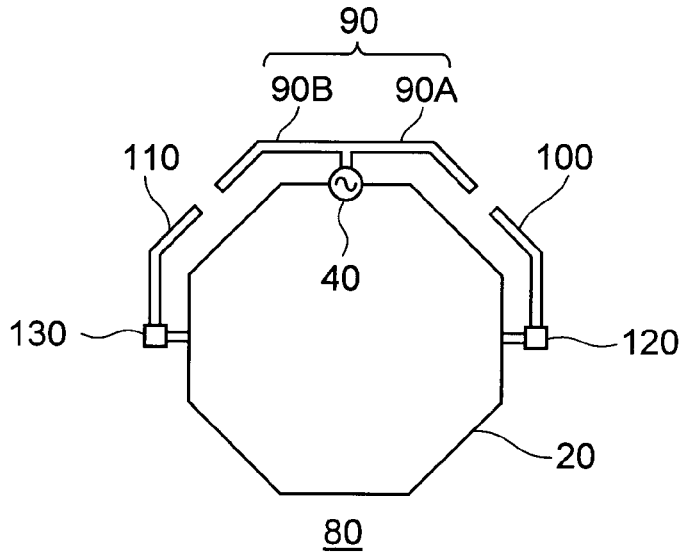
FIG. 13A-13C are diagrams showing another example of the third embodiment in which the shape of a L-shaped monopole conductive element has been changed.
Figure 13B:
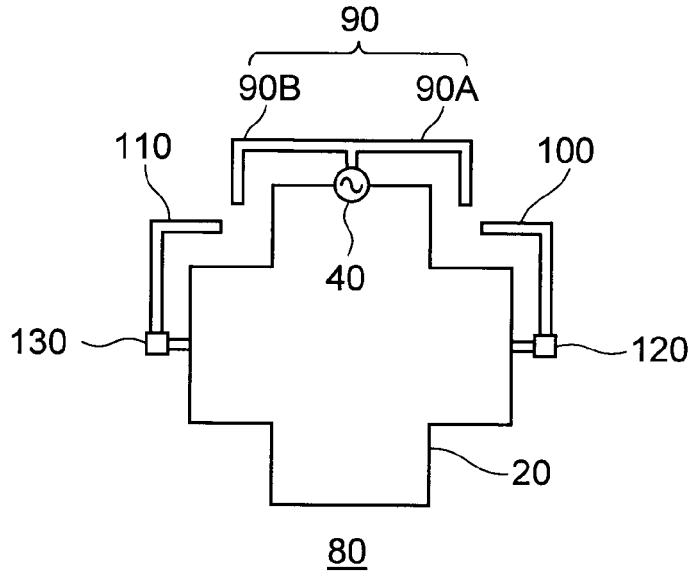
Figure 13C:
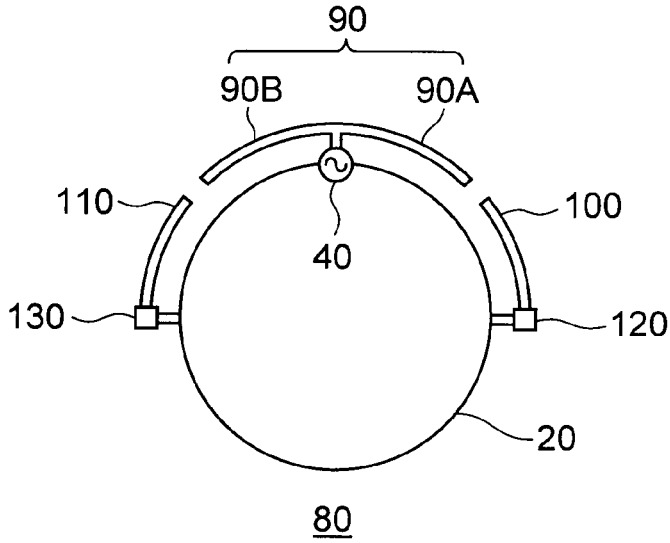
Figure 14:
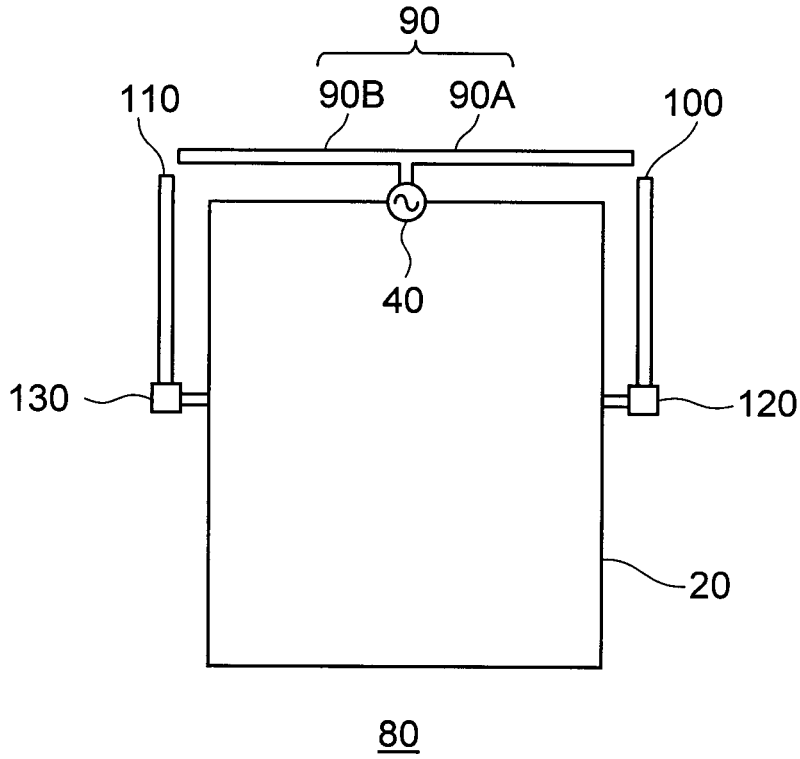
FIG. 14 is a diagram showing another example of the third embodiment in which the shape of the conductive ground plane has been changed.

FIG. 12 is a variation of FIG. 11, in which the shape of the conductive ground plane 20 is changed from a quadrate to a 4-fold rotationally symmetrical shape. FIG. 12(A) is an octagon, (B) is a cross-shape, and (C) is a circular shape. FIG. 13 is a further variation of FIG. 12, and shows an arrangement in which the two L-shaped monopole conductive elements 100 and 110 are shaped in conformity to the sides of the peripheries of the conductive ground planes 20. FIG. 14 is a variation of FIG. 11, in which the shape of the conductive ground plane 20 is changed to a rectangle. In the same manner as in the first embodiment, as shown in FIGS. 12 to 14, by deforming the conductive ground plane 20 according to a location at which the antenna is to be implemented, space saving may be achieved.

(4) Fourth Embodiment

Figure 15:
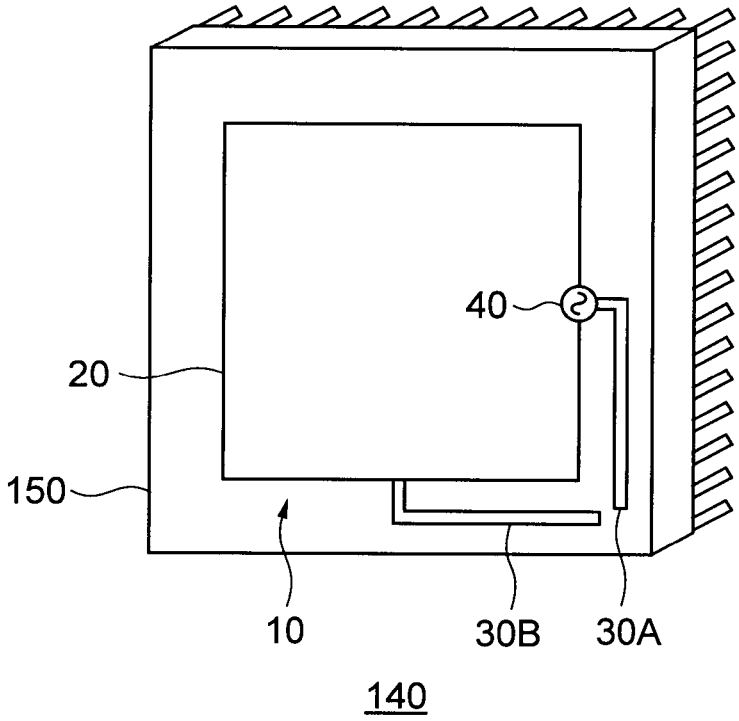
FIG. 15 is a diagram showing a general configuration of a circularly polarized antenna device according to a fourth embodiment of the present invention.

FIG. 15 is a diagram showing a general configuration of a circularly polarized antenna device 140 according to a fourth embodiment of the present invention. In the circularly polarized antenna device 140 shown in FIG. 15, the circularly polarized antenna device 10 shown in FIG. 1 is provided on a semiconductor package 150. The circularly polarized antenna device 10 shown in FIG. 1 may alternatively be embedded in the semiconductor package 150.

By providing the semiconductor package 150 with the circularly polarized antenna device 10 shown in FIG. 1, in addition to the circularly polarized wave characteristics of a good axial ratio in a maximum radiation direction, the wideband frequency and wide angle characteristics, since the module itself is the antenna device, there is no need to arrange an antenna elsewhere. As a result, space saving may be achieved.

(5) Fifth Embodiment

Figure 16:
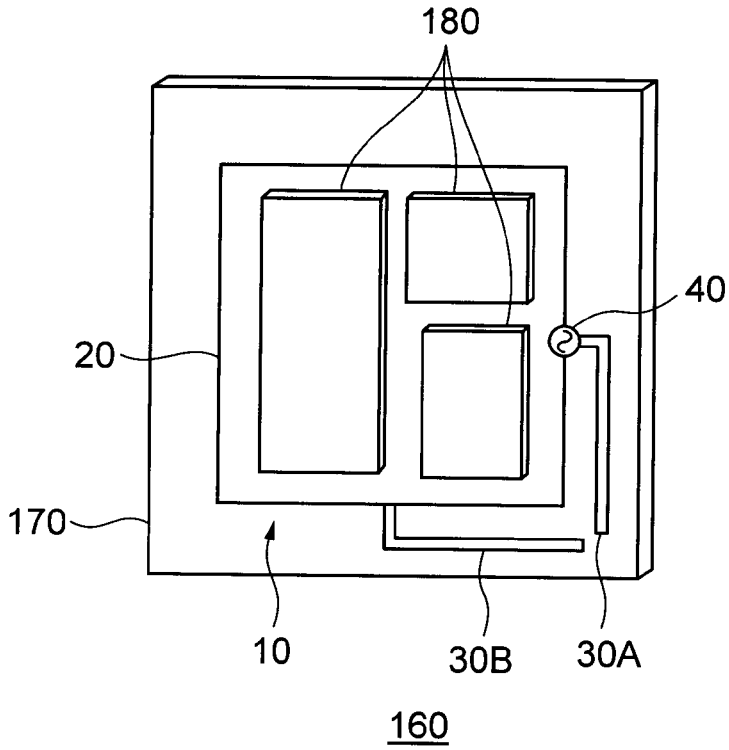
FIG. 16 is a diagram showing a general configuration of a circularly polarized antenna device according to a fifth embodiment of the present invention.

FIG. 16 is a diagram showing a general configuration of a circularly polarized antenna device 160 according to a fifth embodiment of the present invention. In the circularly polarized antenna device 160 shown in FIG. 16, wireless circuits 180 is provided on a conductive ground plane 20 of the circularly polarized antenna device 10 shown in FIG. 1, which is formed on a substrate 170.

By disposing the wireless circuits 180 on the conductive ground plane 20, in addition to the circularly polarized wave characteristics of a good axial ratio in a maximum radiation direction, the wideband frequency and wide angle characteristics, the integral configuration of the antenna and the wireless circuit enables the entire wireless device to have a small size. In addition, since there is no need to form wiring between the wireless circuits and the antenna, transmission loss attributable to wiring may be reduced.

(6) Other Embodiments

The above-described embodiments are merely examples, and do not restrict the present invention. For instance, the circularly polarized antenna device 10 according to the first embodiment may be applied to an RFID (Radio Frequency IDentification) system.

Figure 17:
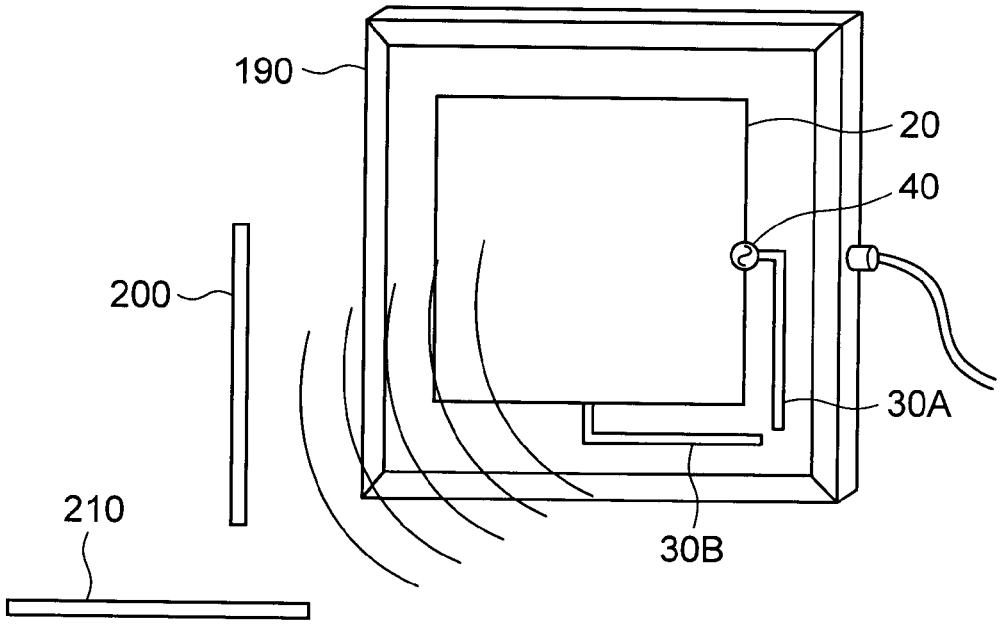
FIG. 17 is a diagram showing a general configuration of a circularly polarized antenna device according to another embodiment of the present invention.

FIG. 17 is a diagram showing a general configuration of a circularly polarized antenna device 190 according to another embodiment of the present invention. The circularly polarized antenna device 190 shown in FIG. 17 is used as a reader/writer antenna in an RFID system. RFID systems are used in, for instance, the field of distribution.

Since the circularly polarized antenna device 190 generates circularly polarized waves having the wideband frequency and wide angle characteristics, communication may be performed in a favorable manner with both an RFID tag 200 having a vertically polarized wave and an RFID tag 210 having a horizontally polarized wave, without having to consider the direction of a polarized wave of an RFID tag.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A circularly polarized antenna device comprising:

a conductive ground plane;

first and second monopole conductive elements having approximately the same length and respectively connected via connection points to the conductive ground plane; and a feeding point provided at either one of the connection points; wherein the first and second monopole conductive elements are approximately mutually perpendicular and are disposed so that respective open ends thereof are mutually adjacent, and with respect to a straight line passing between the open ends of the first and second monopole conductive elements and through the center of the conductive ground plane, a first conductive ground plane portion formed on a first monopole conductive element-side of the straight line among the conductive ground plane and the first monopole conductive element are formed so as to be approximately symmetrical to a second conductive ground plane portion formed on a second monopole conductive element-side of the straight line among the conductive ground plane and the second monopole conductive element.

2. The antenna device according to claim 1, wherein the conductive ground plane has an approximately 4-fold rotationally symmetrical shape.

3. The antenna device according to claim 1, wherein the first and second monopole conductive elements respectively have lengths of approximately ¼ wavelength, and are respectively connected to a first connection point positioned approximately at the center of a desired first side among a plurality of sides of the conductive ground plane and a second connection point positioned on a second side and having an angular difference of approximately 90 degrees from the first connection point with respect to the center of the conductive ground plane.

4. The antenna device according to claim 3, wherein the first and second monopole conductive elements are both formed so as to have L-shapes.

5. The antenna device according to claim 1, further comprising:

third and fourth monopole conductive elements having approximately same lengths and connected to the conductive ground plane via third and fourth connection points so as to be disposed at positions opposite to the positions at which the first and second monopole conductive elements are connected with respect to the center of the conductive ground plane; and a second feeding point provided at either the third or the fourth connection point so as to be disposed at a position opposite to the position at which the feeding point is provided with respect to the center of the conductive ground plane.

6. The antenna device according to claim 1, wherein the conductive ground plane and the first and second monopole conductive elements are formed on the same plane.

7. The antenna device according to claim 1, further comprising a semiconductor package.

8. The antenna device according to claim 1, further comprising a wireless circuit disposed on the conductive ground plane.

9. A circularly polarized antenna device comprising:

a conductive ground plane;

a conductive element connected to the conductive ground plane and formed so as to have an approximately symmetrical shape with respect to a straight line passing through the center of the conductive ground plane and a connection point connected to the conductive ground plane;

first and second monopole conductive elements connected to the conductive ground plane and having approximately half the length of the conductive element;

a feeding point provided at the connection point of the conductive element and the conductive ground plane; and first and second switches respectively provided on the first and second monopole conductive elements, which switch between connection and nonconnection of the conductive ground plane with the first and second monopole conductive elements; wherein among the conductive element, a first conductive element portion formed on a first monopole conductive element-side of the feeding point and the first monopole conductive element are mutually perpendicular and are arranged so that a first open end of the conductive element and an open end of the first monopole conductive element are mutually adjacent, among the conductive element a second conductive element portion formed on a second monopole conductive element-side of the feeding point and the second monopole conductive element are mutually perpendicular and are arranged so that a second open end of the conductive element and an open end of the second monopole conductive element are mutually adjacent, with respect to a first straight line passing between the first open end of the conductive element and the open end of the first monopole conductive element and through the center of the conductive ground plane, a first conductive ground plane portion formed on a first conductive element-side of the first straight line among the conductive ground plane and the first conductive element portion are formed so as to be approximately symmetrical to a second conductive ground plane portion formed on a first monopole conductive element-side of the first straight line among the conductive ground plane and the first monopole conductive element, and with respect to a second straight line passing between the second open end of the conductive element and the open end of the second monopole conductive elements and through the center of the conductive ground plane, a third conductive ground plane portion formed on a second conductive element-side of the second straight line among the conductive ground plane and the second conductive element portion are formed so as to be approximately symmetrical to a fourth conductive ground plane portion formed on a second monopole conductive element-side of the second straight line among the conductive ground plane and the second monopole conductive element.

10. The antenna device according to claim 9, wherein the conductive ground plane has an approximately 4-fold rotationally symmetrical shape.

11. The antenna device according to claim 9, wherein the conductive element is formed so that the length between the first and second open ends is approximately ½ wavelength, and the two monopole conductive elements have lengths of approximately ¼ wavelength and are respectively connected to first and second positions, which have angular differences of plus-minus 90 degrees from the connection point of the conductive element and the conductive ground plane with respect to a center of the conductive ground plane, and which are located on desired sides among a plurality of sides of the conductive ground plane.

12. The antenna device according to claim 11, wherein the conductive element is formed so as to have a T-shape.

13. The antenna device according to claim 9, wherein the conductive ground plane, the conductive element, and the first and second monopole conductive elements are formed on the same plane.

14. The antenna device according to claim 9, further comprising a semiconductor package.

15. The antenna device according to claim 9, further comprising a wireless circuit disposed on the conductive ground plane.

* * * * *